US006571547B2

(12) United States Patent
Llongueras

(10) Patent No.: US 6,571,547 B2
(45) **Date of Patent: *Jun. 3, 2003**

(54) REFRIGERATING-LUBRICATING CURSOR RING

(76) Inventor: Jordi Galan I Llongueras, Carretera Rubi, Km. 22, E-08228, Terrassa (ES)

( * ) Notice: Subject to any disclaimer, the term of this patent is extended or adjusted under 35 U.S.C. 154(b) by 0 days.

This patent is subject to a terminal disclaimer.

(21) Appl. No.: 10/057,721

(22) Filed: Jan. 24, 2002

(65) Prior Publication Data

US 2002/0116912 A1 Aug. 29, 2002

Related U.S. Application Data

(63) Continuation of application No. PCT/ES01/00209, filed on May 24, 2001.

(30) Foreign Application Priority Data

May 24, 2000 (ES) ..... 20001315

(51) Int. Cl.[7] ..... D01H 7/60
(52) U.S. Cl. ..... 57/120

(58) Field of Search ..... 57/1 R, 58.83, 57/75, 112, 119, 120, 121, 122, 123, 124, 125, 126, 137, 352, 354, 355, 356, 357

(56) References Cited

U.S. PATENT DOCUMENTS 3,302,382 A * 2/1967 Kluttz ..... 57/120
3,866,404 A * 2/1975 Doleman et al. ..... 57/119

* cited by examiner

*Primary Examiner*—John J. Calvert
*Assistant Examiner*—Shaun R Hurley

(57) ABSTRACT

The invention relates to a refrigerating-lubricating cursor ring that can be used in ring twisting machines, continuous ring spinning machines and double twisting machines. Said ring serves as a guide for a cursor (3) and comprises a cylindrical, hollow ring (1) made of a porous material, said ring being provided with chamber (6) into which an air-lubricant/refrigerant mixture is injected by pressure, thereby creating an air cushion between the ring (1) and the cursor (3) that prevents mutual friction, lubricates the contact area between said ring and cursor and cools them to prevent wear and heating of the ring (1) and cursor (3) at high speeds. This makes it possible to significantly increase the working speed of the rings in twisting and continuous spinning machine.

2 Claims, 1 Drawing Sheet

REFRIGERATING-LUBRICATING CURSOR RING

This application is a Continuation of PCT/ES01/00209 Filed May 24, 2001.

OBJECT OF THE INVENTION

The object of the present invention, as shown by its title, is related to a refrigerating-lubricating cursor ring with application in ring twisting machines, continuous ring spinning frames and double twisting frames, in order to prevent wear on the traveller at high speeds, facilitating the significant increase of working speeds of the rings of twisting and continuous ring spinning frames.

BACKGROUND

At present the rings of twisting and continuous ring spinning frames are limited in their capability to twist thread at high speeds. Surpassing these limitations brings about premature wearing out of the traveller due to the heating of the ring caused by the traveller rubbing on the ring during the twist and winding operation, and the fact that the lubrication of the ring-traveller friction surface is not completely homogeneous nor constant. The lubrication of the present rings of twisting and continuous spinning frames offers a non-homogeneous spreading of the lubricant over the ring-traveller friction surface and lubrication of an area of the ring where no contact occurs between the ring and the traveller, thus causing oil to be wasted. This spreading of lubricant over the surface of the ring makes for inefficient lubrication.

DESCRIPTION OF THE INVENTION

The refrigerating-lubricating cursor ring has been developed with the objective of overcoming the current limitations, under conditions of normal wear, in the field of the aforementioned twisting and continuous spinning frames.

The refrigerating-lubricating cursor ring consists of a hollow, cylindrical-shaped ring made of sintered material that is cooled and lubricated with a mixture of compressed air and lubricant (preferably oil or water-based emulsions with oil) proceeding from an external mixer.

The outside of the ring portion includes a slot that is the entrance into an inner chamber inside the ring and which is sealed and insulated by a gasket, thus preventing any possible leakage. This chamber is connected to the exterior by a cylindrical hole, which is the entry passage for the air-lubricant/cooler mixture. This section also includes, on the outer face of the ring where no contact between the ring and the traveller occurs, a layer of sealing varnish, the purpose of which is to prevent any leakage of the air-lubricant/cooling mixture in this area.

On the outside there is a shoulder, an integrated part of the ring, the purpose of which is to serve as a stopper for the ring to fix it onto the corresponding mount on the twisting and continuous spinning frames.

The ring portion includes several necks on its lower outer face and on its upper inner face, the purpose of which is to facilitate optimal sliding of the traveller in the case of the lower neck and to facilitate the passing of the thread in the case of the upper neck.

The air-lubricant/cooler mixture is pressure injected, the temperature and proportion of the air-lubricant mixture components being determined in accordance with the type of thread being processed, into an inner chamber of the cooler-lubricant traveller ring by way of the air pressure proceeding from an external compressor apparatus connected to a thermostat, a device that facilitates air temperature grading in order to carry out ring cooling, and from the thermostat to the mixer. This pressure makes the air-lubricant/cooler mixture pass through the pores of the ring, on the one hand carrying out a homogeneous spreading of the mixture over the ring-traveller contact area, while at the same time cooling the ring as a consequence of the temperature of the air being introduced into the ring and the cooling carried out by heat exchange between the ring and the air being sent out from the inside of the ring to the surrounding atmosphere.

The portions of the different kinds of ring to which the refrigerating-lubricating cursor ring can be applied to are the following:

"HZ portion straight type" rings.

"J portion conical type" rings.

Rings for continuous cotton machinery.

Any possible ring portion.

As a consequence of the pressure made by air, as well as the lubrication of the contact surface between the ring and the traveller brought about by the oil, an air cushion between the traveller and the ring is also created, thus reducing rubbing even more, and therefore preventing the traveller from being worn down at high speeds, facilitating a significant increase in the working speed of the rings of twisting and continuous spinning frames.

BRIEF DESCRIPTION OF THE DRAWINGS

A preferred practical embodiment of the refrigerating-lubricating cursor ring object of the present invention is described below, to provide a better understanding of the object of the present invention, based on the illustrations attached.

PREFERRED EMBODIMENT OF THE INVENTION

Figure 1:
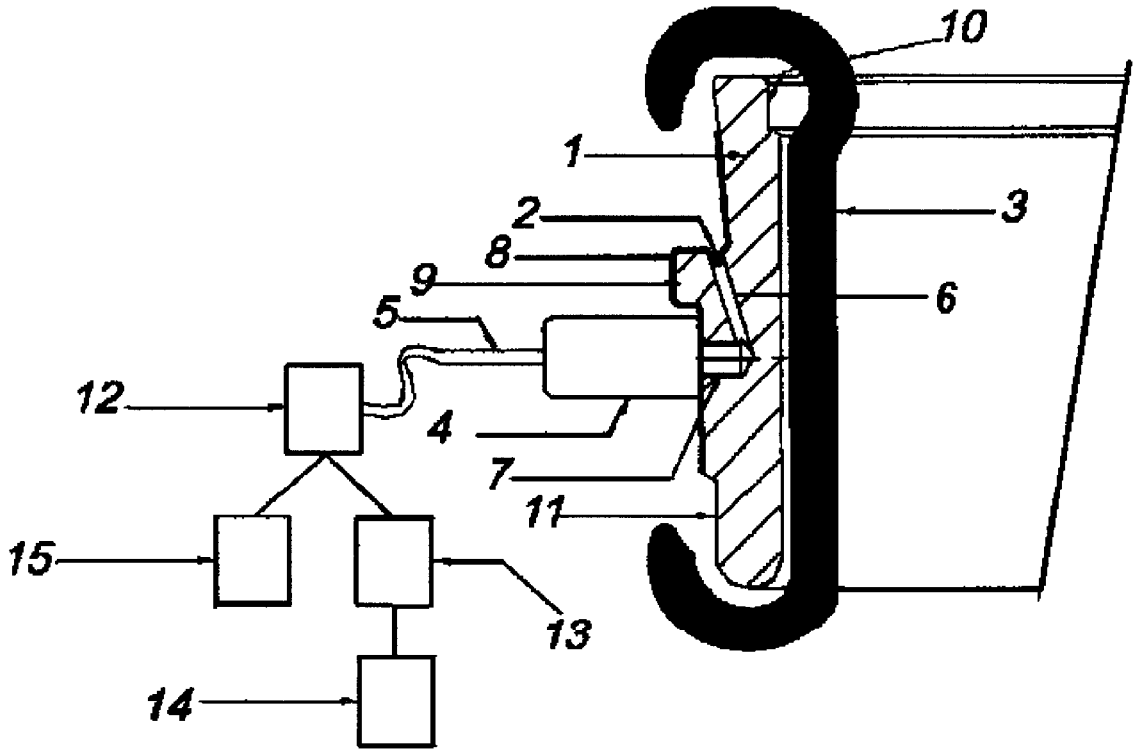
FIG. 1: Refrigerating-lubricating cursor ring portion

The refrigerating-lubricating cursor ring (1) consists of a hollow, cylindrical-shaped ring made of sintered material, preferably built with material of iron, aluminium or plastic origin.

The cooler lubricator ring (1) has a degree of porosity of between 0.1% and 50% in relation to the volume or specific weight of the refrigerating-lubricating cursor ring (1).

The refrigerating-lubricating cursor ring (1) includes an inner chamber (6) in its interior that consists of a hollow that runs all the way along the circular wall of the ring (1) and partially along its height. This inner chamber (6) is covered at the end that meets the outer wall of the ring (1) and which connects with the exterior, by way of a pressure attached gasket (2), preferably made of rubber, whose purpose is to seal off the inner chamber (6) from the exterior in order to prevent leakage of the air-lubricant/cooler mixture as well as possible pressure loss. Said inner chamber (6) is connected to the exterior by a cylindrical conduct (7) through which the air-lubricant/cooler mixture is conducted. The air-lubricant/cooler mixture is introduced by way of a preferably metallic connector (4), that facilitates the connection between the inner chamber (6) and a preferably plastic tube (5), which leads the air-lubricant/cooler mixture from the mix, from the mixer (12) to the connector (4) and the cylindrical conduct (7). The wall of the refrigerating-lubricating cursor ring (1) includes a layer of sealing varnish (8) on the part of the outer face of the ring (1) where no contact is made between the ring (1) and the traveller (3), the purpose of this sealing varnish (8) being to prevent loss of the air-lubricant/cooler mixture from this area and thus avoid any leakage. The wall of the refrigerating-lubricating cursor ring (1) includes a first upper neck or narrowing (10) located on the upper part and the inner face of the ring (1) and a second lower neck or narrowing (11) on the lower part of the outer face, the purpose of which is to facilitate optimal sliding of the traveller in the case of the lower neck (11) and to facilitate the thread passing through in the case of the upper neck (10).

On the outer face of the ring (1) there is a shoulder (9), an integrated part of said ring (1), the purpose of which is for use as a stopper for the ring (1) to fix it onto the corresponding mount on the twisting and continuous spinning frames.

This ring serves as a rail for a traveller (3), preferably made of plastic and with an adequate size in relation to the ring (1) and to the characteristics of the thread to be twisted. This traveller (3) serves as a guide for the thread for the direction change that it must carry out before being winded onto the spool.

The refrigerating-lubricating cursor ring (1) facilitates the cooling of the traveller by way of air temperature control (13) of the air-lubricant/cooler mixture, selected by sources external to the ring, such as a thermostat, in the range of between −150° C. and +50° C. Temperature control is carried out at the output of the compressed air source and before the air enters the mixer (12). The pressure of the air-lubricant/cooler mixture is due to its being made with compressed air. This pressure is gradable, and a pressure range of between 0.2 bar and 80 bar can be used. The air-lubricant/cooler mixture is made in a mixer (12) outside the refrigerating-lubricating cursor ring (1). The mixture of the oil, with a viscosity of between 1 and 250 centistockes at 50° C., in accordance with ISO regulations, allowing for a homogeneous lubrication depending on the characteristics of the thread to be twisted and on the porosity index of the ring (1), located in a tank (15) of the mixer (12), and the air proceeding from an external compressed air source (14) connected to air temperature control (13), is carried out in this mixer (12). This mixer (12) facilitates the grading of the mixture in a range between 100% air and 0% lubricant and 0% air and 100% lubricant, preferably oil or water-based emulsions with oil, depending on the characteristics of the thread and the material of the ring (1) and the traveller (3) that are being used.

The pressure injection of the air-lubricant/cooler mixture, together with the porosity of the ring (1) allow it to sweat the air-lubricant/cooler mixture facilitating constant and homogeneous lubrication of the contact surface between the ring (1) and the traveller (3), while an air cushion is created between them, thus reducing mutual rubbing and obtaining proper cooling of the ring (1) and the traveller (3) so as to allow for high working speeds.

Having sufficiently described the nature of the present invention, as well as the method for putting it into practice, we only need add that changes in its form, materials and disposition may be introduced into its totality or parts as long as said alterations do not substantially alter the characteristics of the invention claimed.

What is claimed is:

1. A refrigerating-lubricating cursor ring that serves as a rail for a traveller, comprising a hollow, cylindrical-shaped ring made of sintered material of iron, aluminium or plastic origin and having an outer part that includes a slot forming an entrance into an inner chamber, the chamber being sealed and insulated from an exterior of the ring by a gasket situated over said slot, the chamber being connected to the exterior by a cylindrical hole to which a connector is attached, the ring having a shoulder on an outer face of the ring that serves as a stopper to fix said ring onto a twister and continuous spinning frame, the ring including a first narrowing on an upper portion of an inner face and a second narrowing on a lower portion of the inner face, wherein the ring has a layer of sealing varnish on an area of the surface of the outer face of the ring where no contact occurs between the ring and the traveller to prevent leakage of air or an air-lubricant/cooler mixture from said area;

the sintered material ring is porous; and the porosity of the material of the ring is chosen to facilitate the distribution of air or the air-lubricant mixture through the pores formed by the sintered material of the ring so that a homogeneous and constant flow is produced throughout a contact area between the ring and the traveller and an air cushion between said ring and said traveller is generated to reduce rubbing and preventing wearing and heating of said traveller.

2. The refrigerating-lubricating cursor ring according to claim 1, characterised in that the degree of porosity of the material of the ring is between 0.1% and 50% of the volume of the ring.

* * * * *